US010096932B2

(12) United States Patent
Chang et al.

(10) Patent No.: US 10,096,932 B2
(45) Date of Patent: Oct. 9, 2018

(54) WATERPROOF ELECTRICAL CONNECTOR

(71) Applicant: FOXCONN INTERCONNECT TECHNOLOGY LIMITED, Grand Cayman (KY)

(72) Inventors: Yen-Chih Chang, New Taipei (TW); Shu-Jian Wang, Kunshan (CN); Zhi-Hui Zhu, Kunshan (CN); Peng-Ye Zhao, Kunshan (CN); Da-Wei Zhang, Kunshan (CN); Qin-Xin Cao, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/659,635

(22) Filed: Jul. 26, 2017

(65) Prior Publication Data

US 2018/0034195 A1 Feb. 1, 2018

(30) Foreign Application Priority Data

Jul. 27, 2016 (CN) ..... 2016 2 0796651 U

(51) Int. Cl.
*H01R 13/52* (2006.01)
*H01R 13/74* (2006.01)
*H01R 13/62* (2006.01)

(52) U.S. Cl.
CPC ..... *H01R 13/5202* (2013.01); *H01R 13/5219* (2013.01); *H01R 13/74* (2013.01); *H01R 13/6205* (2013.01)

(58) Field of Classification Search
CPC ..... H01R 13/52; H01R 13/5202; H01R 13/5205; H01R 13/5219; H01R 13/5221; H01R 33/965
USPC ..... 439/271, 587
See application file for complete search history.

(56) References Cited

U.S. PATENT DOCUMENTS

| | | | | |
|---|---|---|---|---|
| 7,351,066 | B2 | 4/2008 | DiFonzo et al. | |
| 2015/0325944 | A1* | 11/2015 | Chien | H01R 13/5202 439/271 |
| 2016/0104957 | A1* | 4/2016 | Kim | H01R 13/5219 439/78 |

FOREIGN PATENT DOCUMENTS

| | | | |
|---|---|---|---|
| CN | 204732590 | U | 10/2015 |
| CN | 205016762 | U | 2/2016 |
| CN | 205081274 | U | 3/2016 |
| CN | 205195013 | U | 4/2016 |
| CN | 205152742 | U | 11/2016 |

* cited by examiner

*Primary Examiner* — Hae Moon Hyeon
(74) *Attorney, Agent, or Firm* — Wei Te Chung; Ming Chieh Chang

(57) ABSTRACT

An electrical receptacle connector includes an insulative housing, a plurality of terminals retained in the housing, a metallic shell enclosing the housing and defining a mating cavity forwardly communicating with an exterior in a front-to-back direction, a compressible gasket surrounding a front edge region of the shell, and a metallic mounting bracket positioned upon the shell in the vertical direction perpendicular to the front-to-back direction wherein the mounting bracket includes a flange located at the front edge thereof and extending in a vertical direction perpendicular to the front-to-back direction to forwardly abut against the compressible gasket for preventing rearward movement of the compressible gasket.

18 Claims, 8 Drawing Sheets

WATERPROOF ELECTRICAL CONNECTOR

BACKGROUND OF THE DISCLOSURE

1. Field of the Disclosure

The invention is related to an electrical connector, and particularly to a waterproof electrical receptacle connector located behind the panel and equipped with a flange forwardly abutting against a rubber gasket surrounding a front edge region of the metallic shell of the electrical connector through which the complementary plug connector is inserted into mating cavity in the receptacle connector.

2. Description of Related Arts

China Patent Nos. CN204732590 discloses a waterproof electrical connector including an insulative housing, a plurality of terminals retained in the housing, a metallic shell enclosing the housing, a rubber gasket surrounding a front edge region of the shell, a metallic bracket attached upon the shell for mounting the whole receptacle connector upon the printed circuit board, wherein the front edge of the bracket abuts against the rubber gasket to retain the rubber gasket in position. Anyhow, the front edge of the bracket is relatively too thin to efficiently stop rearward movement of the rubber gasket when the rubber gasket is significantly compressed by the panel of the computer enclosure for sufficient sealing consideration between the receptacle connector and the panel. Therefore, there is high possibility for the rubber gasket to rearwardly move for releasing compression thereof, thus jeopardizing waterproof sealing between the receptacle connector and the panel.

It is desired to provide an improved receptacle connector with the rubber gasket reliably retained in the correct position without backward movement for assuring waterproof sealing between the panel and the receptacle connector.

SUMMARY OF THE DISCLOSURE

To achieve the above desire, an electrical receptacle connector includes an insulative housing, a plurality of terminals retained in the housing, a metallic shell enclosing the housing and defining a mating cavity forwardly communicating with an exterior in a front-to-back direction, a compressible gasket surrounding a front edge region of the shell, and a metallic mounting bracket positioned upon the shell in the vertical direction perpendicular to the front-to-back direction wherein the mounting bracket includes a flange located at the front edge thereof and extending in a vertical direction perpendicular to the front-to-back direction to forwardly abut against the compressible gasket for preventing rearward movement of the compressible gasket.

DETAILED DESCRIPTION OF THE PREFERRED EMBODIMENT

Figure 1:
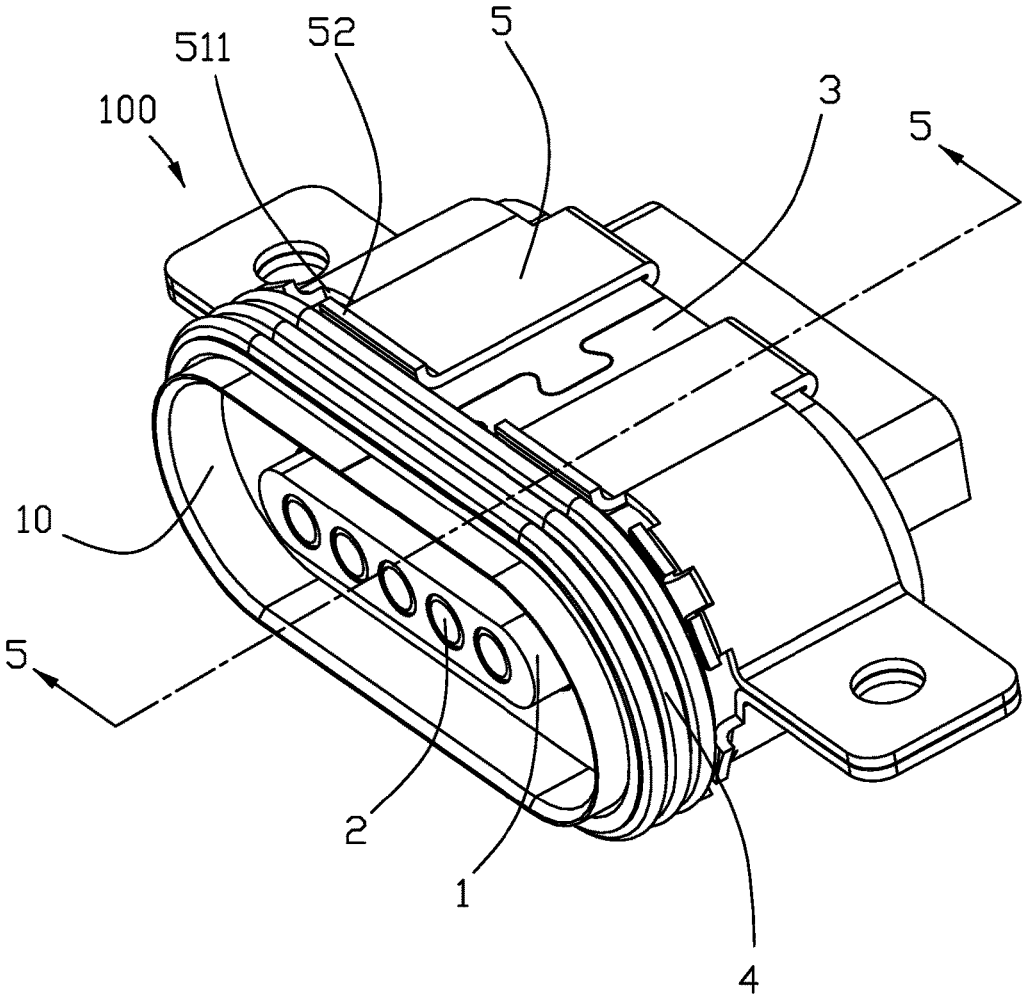
FIG. 1 is a perspective view of an electrical connector of the invention according to the first embodiment.
Figure 2:
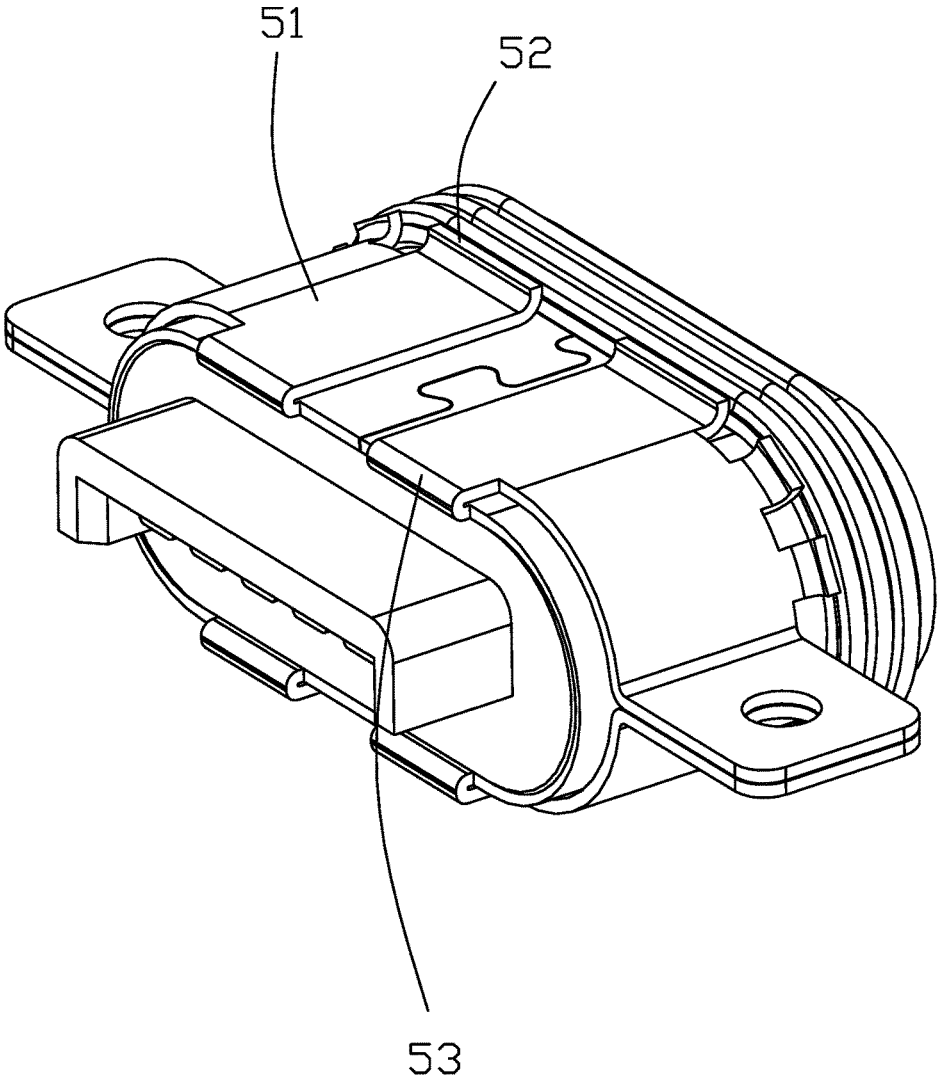
FIG. 2 is another perspective view of the electrical connector of FIG. 1.
Figure 3:
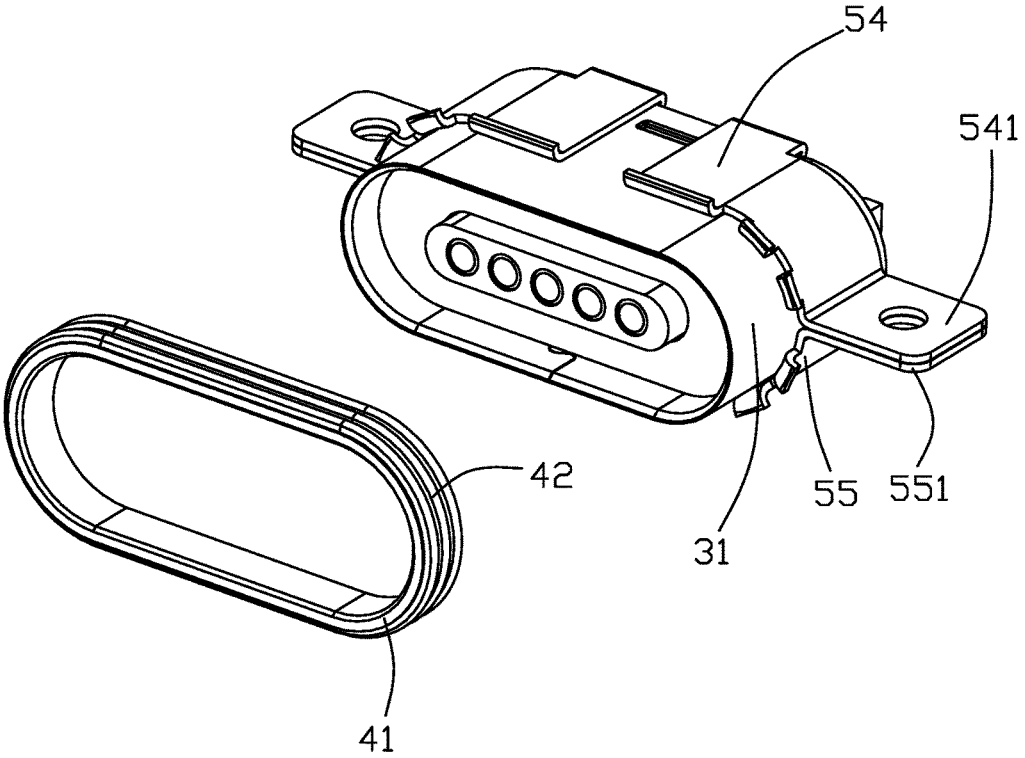
FIG. 3 is exploded perspective view of the electrical connector of FIG. 1.
Figure 4:
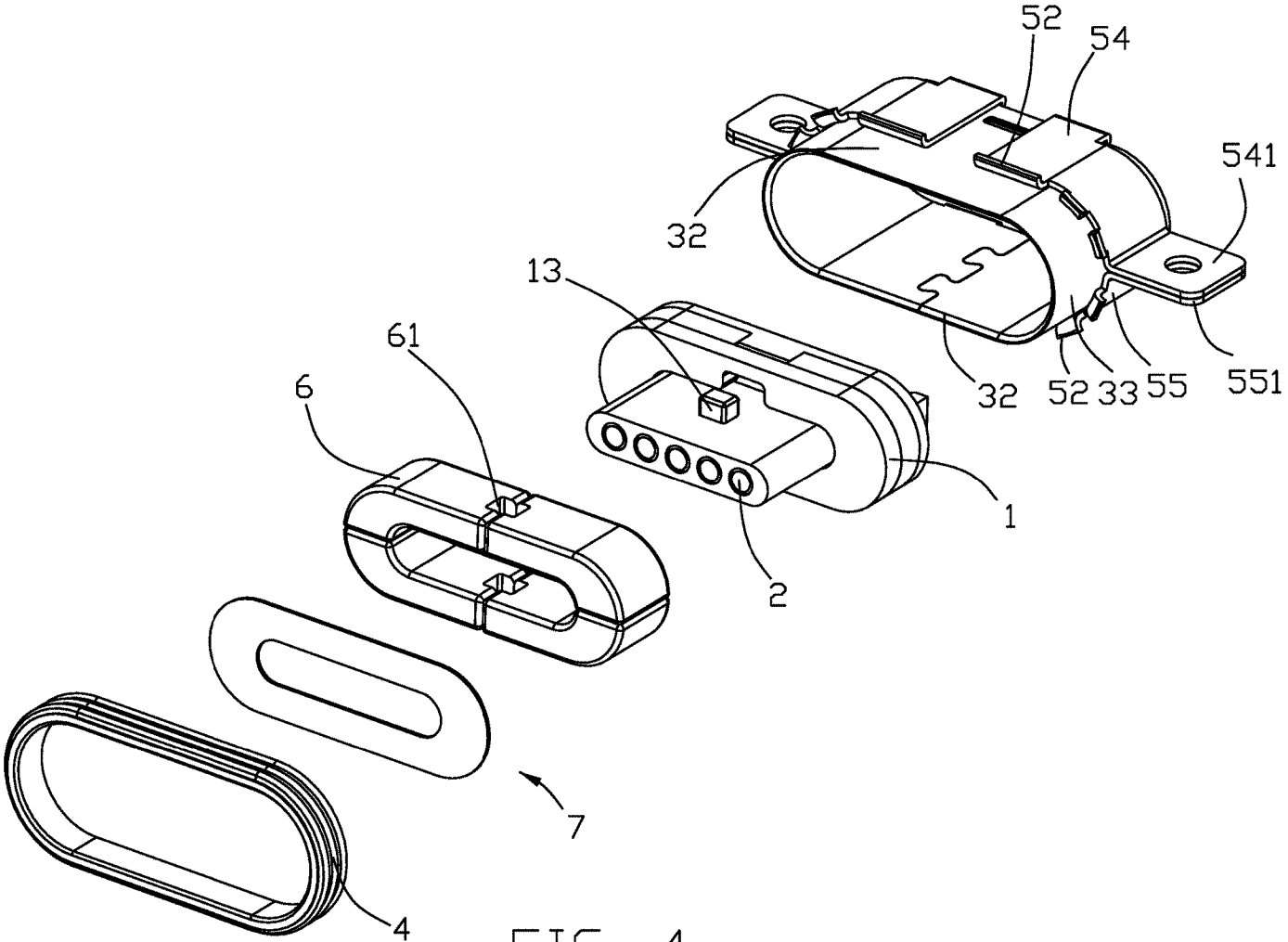
FIG. 4 is a further exploded perspective view of the electrical connector of FIG. 3.
Figure 5:
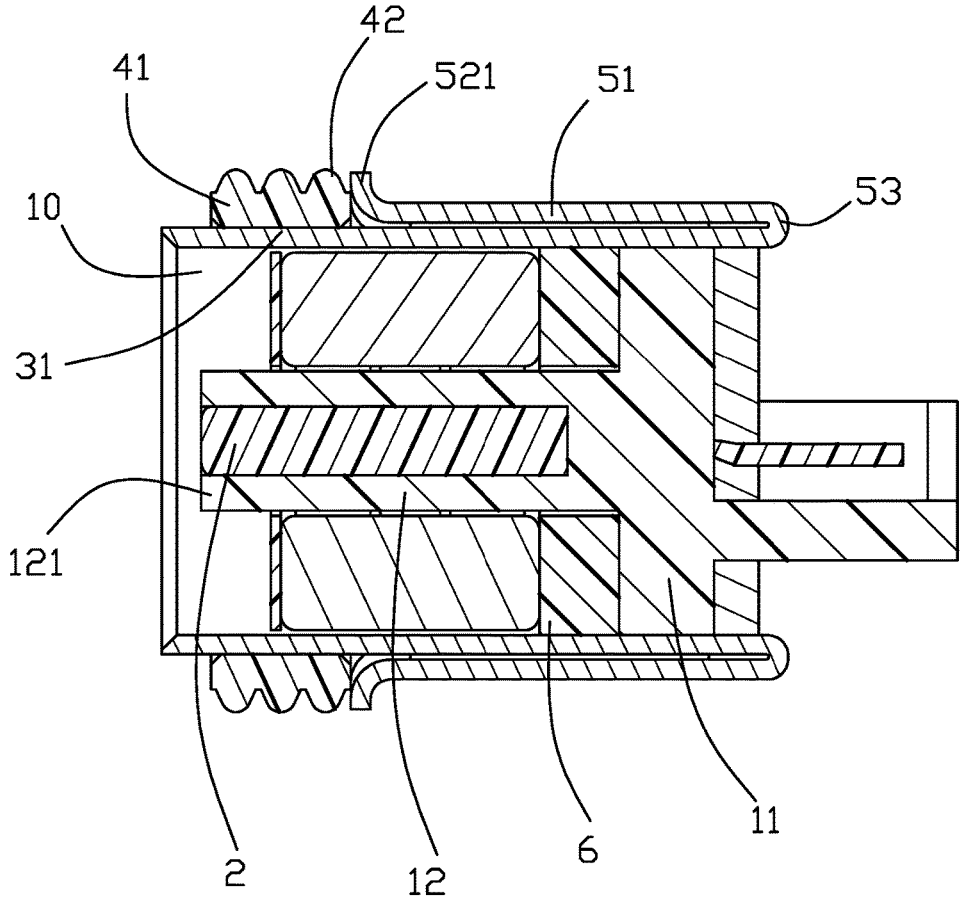
FIG. 5 is a cross-sectional view of the electrical connector of FIG. 1.

Reference will now be made in detail to the embodiments of the present disclosure. Referring to FIGS. 1-5, a waterproof electrical plug connector 100 includes an insulative housing 1, a plurality of conductive terminals 2 retained in the housing, a metallic shell 3 enclosing the housing 1, a waterproof gasket 4 and a metallic mounting bracket 5.

The metallic shell 3 includes a mating port 31 for mating with a complementary plug connector (not shown). The housing includes a base 11 and a mating tongue 12 extending from the base 11. The mating tongue 12 includes a front end face 121. The mating port 31 surrounds the mating tongue 12 to commonly form a mating cavity 10. The front end face 121 is rearwardly offset from the front end of the mating port 31, and the terminals 2 are exposed upon the front end face 121 toward the mating cavity 10.

A pair of blocks 13 are formed on upper and lower sides of the mating tongue 12, and four magnets 6 are assembled upon a root area of the mating tongue 12. The magnets 6 include cutouts 61 compliantly receiving the blocks 13. The contour of the four magnets 6 is similar to that of the base 11, and an adhesive protection layer 7 is applied upon the front faces of those four magnets 6.

The waterproof gasket 4 is made from insulative material or rubber with inherent elasticity and/or compressibility thereof. The waterproof gasket 4 surrounds a front end region of the mating port 31 and includes an annular main portion 41 with the bulged interference portion 42 thereon. In this embodiment, the thickness of the main portion 41 is less than the extending dimension of the flange 52 (illustrated later) of the mounting bracket 5 in the vertical direction. Notably, when the connector 100 is assembled into a panel of the computer enclosure wherein the front end region of the mating port 31 is located around an insertion hole formed in the panel, the waterproof gasket 4 is compressed inwardly along the front-to-back direction and rearwardly/radially by the panel around the insertion hole in the panel.

The metallic mounting bracket 5 is positioned upon the metallic shell 3 and behind the waterproof gasket 4. In this embodiment, the metallic bracket 5 is unitarily formed with the metallic shell 3 via a folded structure, i.e., the bending portion or bridge 53.

The metallic mounting bracket 5 includes a main body 51 intimately attached upon the exterior surface of the metallic shell 3 with a front face 511 spaced from the waterproof gasket 4 wherein a plurality of curved flanges 52 extend from the front face 511 and forwardly abut against the waterproof gasket 4. Notably, when the connector 100 is assembled to the panel of the computer enclosure, the waterproof gasket 4 is endured with a rearward force and the flanges 52 may prevent the rearward movement of the waterproof gasket 4 for maintaining the waterproof gasket in position, thus assuring the superior waterproof sealing function. Understandably, the curved flanges 52 may be deflectable to further compromise the rearward movement of the waterproof gasket 4 in a reinforced sealing manner. Notably, the flanges 52 form tips 521 preventing the waterproof gasket 4 from passing over. The extending dimension of the flange 52 in the vertical direction is around three times of the thickness of the mounting bracket 5 so as to have the flanges 52 own elasticity for rearward deflection along the front-to-back direction and efficiently stop the backward movement of the waterproof gasket 4. In this embodiment, the curved flanges 52 are not unitarily linked together transversely with one another for easing manufacturability thereof.

The metallic shell 3 defines a capsular cross-section with two long sides 32 and two short sides 33 so as to commonly form a mating part 31. The metallic mounting bracket 5 includes a first/upper part 54 and a second/lower part 55 respectively extending from the corresponding long sides 32 in a folded manner with the corresponding bending portions 53 linked with a rear edge of the metallic shell 3. The first part 54 and the second part 55 both form the corresponding flanges 52, respectively. The first part 54 and the second part 55, which are unitarily formed with the metallic shell 3 via folded structures, extend transversely along an exterior surface of the metallic shell 3 and are terminated at the corresponding short sides 33. The first part 54 composed of two separate pieces, forms a pair of first coupling portions 541 around the corresponding short sides 33, and the second part 55 composed of two separate pieces, forms a pair of second coupling portions 551 around the corresponding short sides 33 wherein the first coupling portions and the second coupling portions are securely stacked with each other to reinforce the whole metallic mounting bracket 5. In this embodiment, the first part 54 and the second part 55 only connect to the corresponding long side 32 while secured to each other around the short sides 33, thus assuring the strength of the whole mounting bracket 5.

Figure 6:
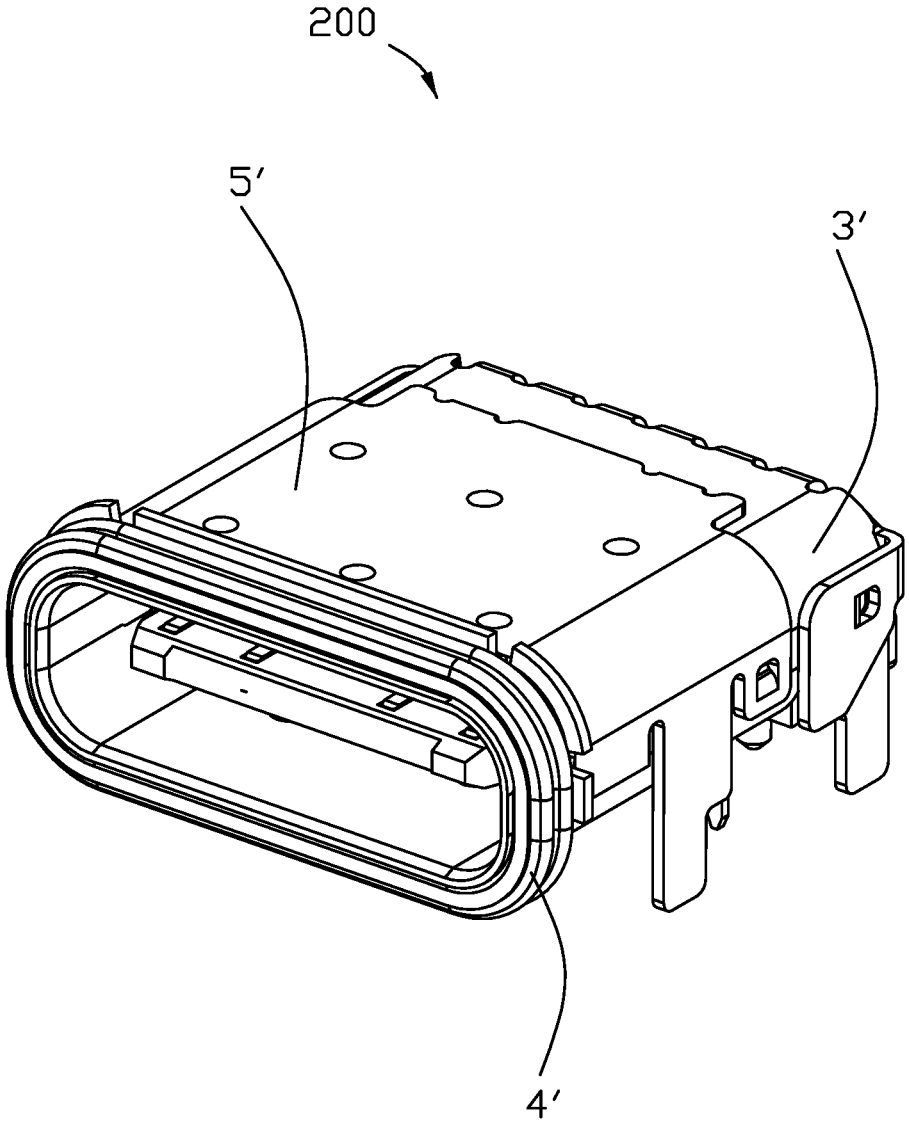
FIG. 6 is a perspective view of the electrical connector of the invention according to another embodiment.
Figure 7:
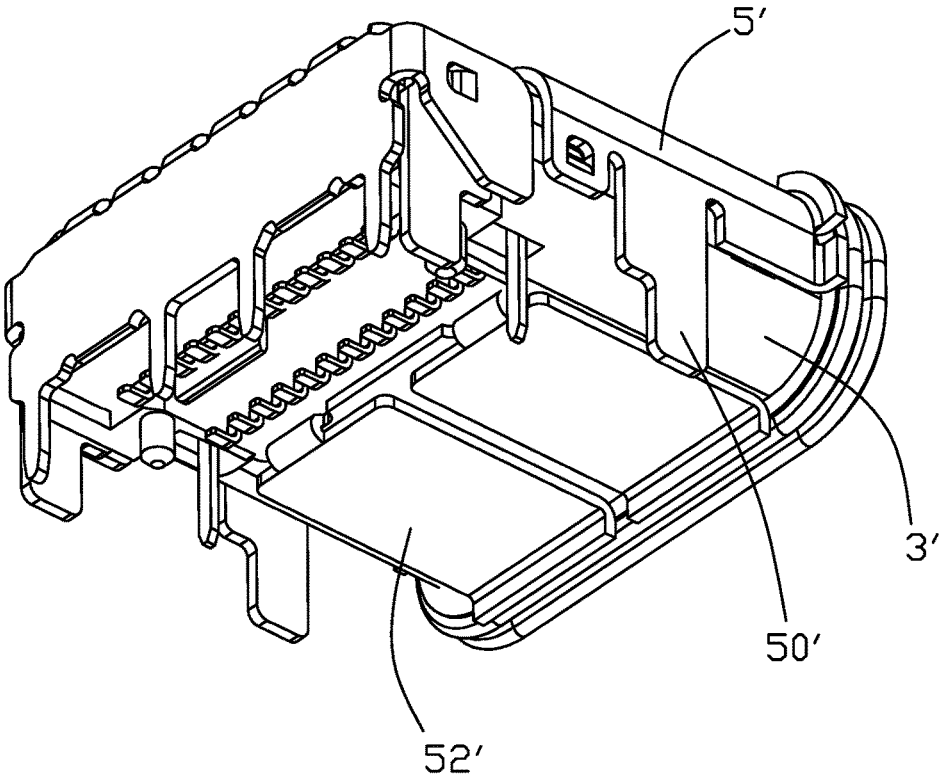
FIG. 7 is another perspective view of the electrical connector of FIG. 6.
Figure 8:
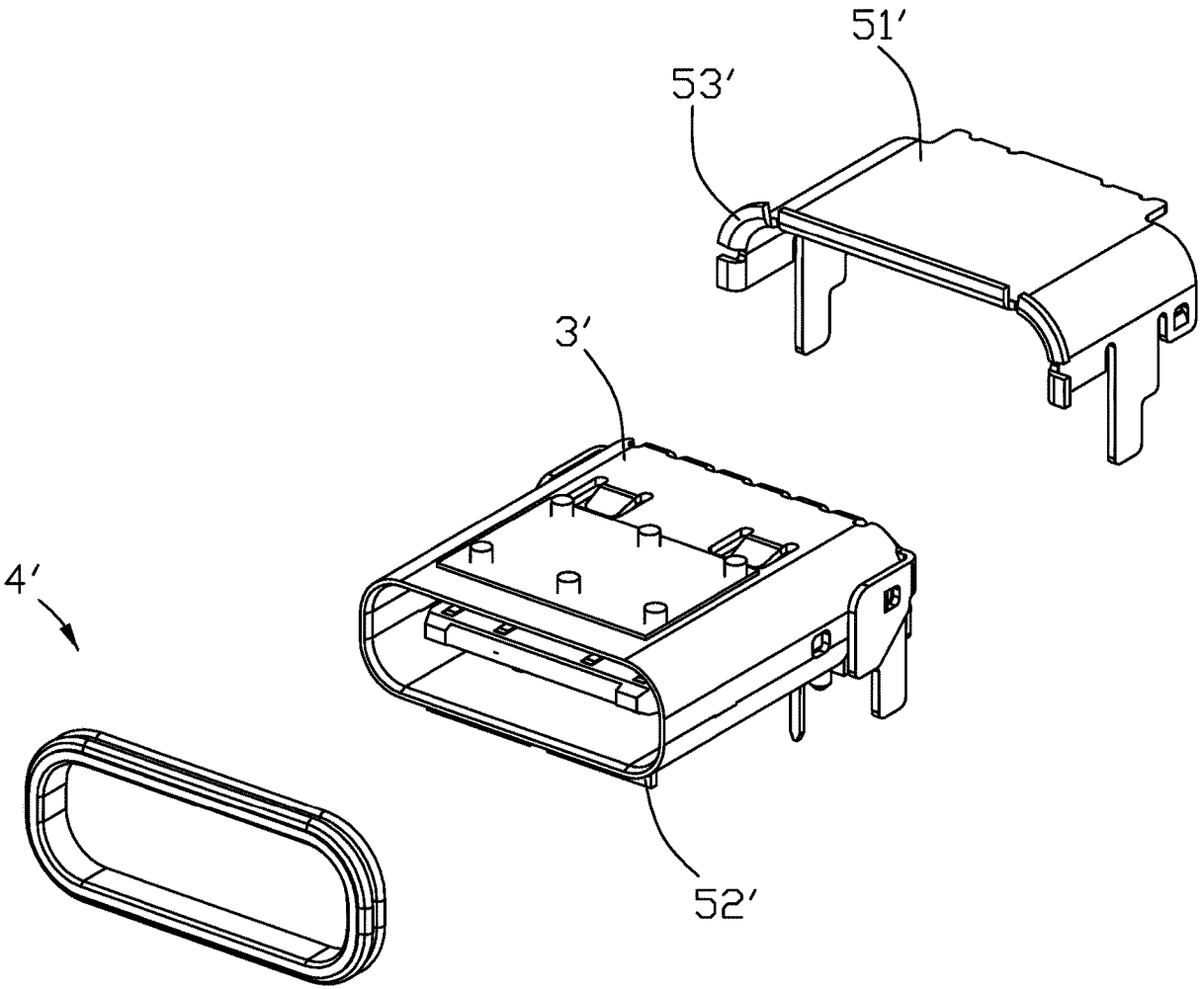
FIG. 8 is an exploded perspective view of the electrical connector of FIG. 6.

Referring to FIGS. 6-8, an electrical connector 200 includes the first part 51' separate from the shell 3' while the second part 52' is unitarily formed with the shell 3' with the corresponding flanges 53' forwardly abutting against the waterproof gasket 4'.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing;

a plurality of terminals retained in the housing;

a metallic shell enclosing the housing and defining a mating port forwardly communicating with an exterior in a front-to-back direction;

a compressible waterproof gasket attached upon a front end region of the shell; and a metallic mounting bracket positioned upon an exterior surface of the shell; wherein the mounting bracket forms flanges at a front edge thereof to efficiently abut forwardly against the waterproof gasket so as to prevent rearward movement of the waterproof gasket over the flange when said waterproof gasket is rearwardly pushed and compressed by a panel.

2. The electrical connector as claimed in claim 1, wherein the mounting bracket is unitarily formed with the shell.

3. The electrical connector as claimed in claim 2, wherein said mounting bracket unitarily extends from a rear edge of the shell via folded structures.

4. The electrical connector as claimed in claim 3, wherein the shell defines a capsular cross-section with a pair of long sides and a pair of short sides, and the folded structures are formed on the long sides only.

5. The electrical connector as claimed in claim 4, wherein the mounting bracket includes a first part and a second part attached to each other around the short sides.

6. The electrical connector as claimed in claim 5, wherein each of said first part and said second part continuously extends transversely in a transverse direction perpendicular to the front-to-back direction while the flanges forms on each of said first par and second part are separated from one another for easy manufacturability consideration.

7. The electrical connector as claimed in claim 1, wherein the flange extends from a front face of the mounting bracket with a distance so as to own elasticity for rearward deflection along the front-to-back direction.

8. The electrical connector as claimed in claim 1, wherein a thickness of a main portion of the waterproof gasket is smaller than the dimension of the flange in a vertical direction perpendicular to the front-to-back direction.

9. The electrical connector as claimed in claim 1, wherein the shell defines a capsular cross-section with a pair of long sides and a pair of short sides, and the mounting bracket has an upper part discrete from the metallic shell extends continuously extends along a transverse direction perpendicular to said front-to-back direction to cover the pair of short sides and one of the pair of long sides while the flanges formed on the upper part are separated from one another in said transverse direction.

10. The electrical connector as claimed in claim 1, wherein an extending dimension of the flange is not less than three times of a thickness of the mounting bracket for efficiently stopping backward movement of the waterproof gasket.

11. An electrical connector comprising:

an insulative housing;

a plurality of terminals retained in the housing;

a metallic shell enclosing the housing and defining a mating port forwardly communicating with an exterior in a front-to-back direction, said shell defining a capsular cross-section with a pair of long sides and a pair of short sides thereof;

a compressible waterproof gasket attached upon a front end region of the shell; and a metallic mounting bracket positioned upon an exterior surface of the shell and intimately positioned behind the compressible waterproof gasket; wherein the mounting bracket includes a first part positioned upon an exterior surface of one of the long sides, and a second part positioned upon an exterior surface of the other of the long sides, and at least one of said first part and said second part unitarily extends from a rear edge of the metallic shell in a folded manner.

12. The electrical connector as claimed in claim 11, wherein both said first part and said second part have corresponding flanges forwardly abutting against the waterproof gasket.

13. The electrical connector as claimed in claim 11, where both said first part and said second part are unitarily formed with the metallic shell via folded structures.

14. The electrical connector as claimed in claim 13, wherein said first part and said second part extend in a transverse direction perpendicular to said front-to-back direction with corresponding coupling portions stacked with each other in a vertical direction perpendicular to both said front-to-back direction and said transverse direction.

15. The electrical connector as claimed in claim 11, wherein the first part discrete from the metallic shell extends continuously extends along a transverse direction perpendicular to said front-to-back direction to cover the pair of short sides and one of the pair of long sides while the flanges formed on the mounting first part are separated from one another in said transverse direction.

16. An electrical connector comprising:

an insulative housing;

a plurality of terminals retained in the housing;

a metallic shell enclosing the housing and defining a mating port forwardly communicating with an exterior in a front-to-back direction, said shell defining a capsular cross-section with a pair of long sides and a pair of short sides thereof;

a compressible waterproof gasket attached upon a front end region of the shell; and a metallic mounting bracket positioned upon an exterior surface of the shell and intimately positioned behind the compressible waterproof gasket; wherein said mounting bracket includes an upper part composed of two separate pieces respectively linked to a rear edge of the metallic shell via corresponding folded structures, respectively, each of said separate pieces extends away from each other in opposite transverse directions perpendicular to the front-to-back direction with corresponding coupling portions around the corresponding short sides.

17. The electrical connector as claimed in claim 16, wherein each of said separate pieces is equipped with a flange around a front edge thereof.

18. The electrical connector as claimed in claim 17, further including a lower part having similar structures with the upper part so as to have the coupling portions of the upper part secured with those of the lower part in a vertical direction perpendicular to both said front-to-back direction and said transverse direction.

* * * * *